US005301649A

United States Patent [19]

Achleitner et al.

[11] Patent Number: 5,301,649

[45] Date of Patent: Apr. 12, 1994

[54] IGNITION DEVICE FOR INTERNAL COMBUSTION ENGINES

[75] Inventors: Erwin Achleitner, Regensburg; Hellmut Freudenberg, Pentling; Manfred Wier, Wenzenbach; Thomas Elbe, Laaber, all of Fed. Rep. of Germany

[73] Assignee: Siemens Aktiengesellschaft, Munich, Fed. Rep. of Germany

[21] Appl. No.: 989,229

[22] Filed: Dec. 11, 1992

[30] Foreign Application Priority Data

Dec. 17, 1991 [EP] European Pat. Off. ..... 91121608.3

[51] Int. Cl.[5] ..... F02P 9/00

[52] U.S. Cl. ..... 123/609; 123/611

[58] Field of Search ..... 123/609, 416, 417, 425, 123/611; 364/431.04

[56] References Cited

U.S. PATENT DOCUMENTS

| | | | |
|---|---|---|---|
| 3,921,062 | 11/1975 | Kuhn et al. | 123/609 |
| 4,467,776 | 8/1984 | Mezger et al. | 123/609 |
| 4,750,467 | 6/1988 | Neuhalfen | 123/611 |
| 4,794,900 | 1/1989 | Stübs et al. | 123/609 |
| 4,915,086 | 4/1990 | Cileberto et al. | 123/609 |
| 5,143,553 | 9/1992 | Mukaihira et al. | 123/609 |

FOREIGN PATENT DOCUMENTS

| | | | |
|---|---|---|---|
| 132985 | 2/1985 | European Pat. Off. | 123/609 |
| 458993 | 12/1991 | European Pat. Off. | 123/609 |
| 470277 | 2/1992 | European Pat. Off. | 123/609 |
| 2145285 | 3/1973 | Fed. Rep. of Germany | 123/609 |
| 3447341 | 6/1986 | Fed. Rep. of Germany | 123/609 |
| 1583307 | 1/1981 | United Kingdom | 123/609 |

*Primary Examiner*—Raymond A. Nelli

*Attorney, Agent, or Firm*—Herbert L. Lerner; Laurence A. Greenberg

[57] ABSTRACT

An ignition device for internal combustion engines includes an ignition coil with separate primary and secondary windings. A sensor is connected in a spark plug current circuit. A peak value of an ignition current for each ignition is stored in a peak value rectifier and is subsequently processed into a value of a closing duration of the primary circuit, which is maintained at a constant by a control value regulation, to compensate for deviations and soiling or age condition changes in the ignition circuit. The closing duration is ascertained cylinder-selectively below an engine rpm limit value, is ascertained above this limit value only for a predetermined cylinder and is used for all of the remaining cylinders.

10 Claims, 1 Drawing Sheet

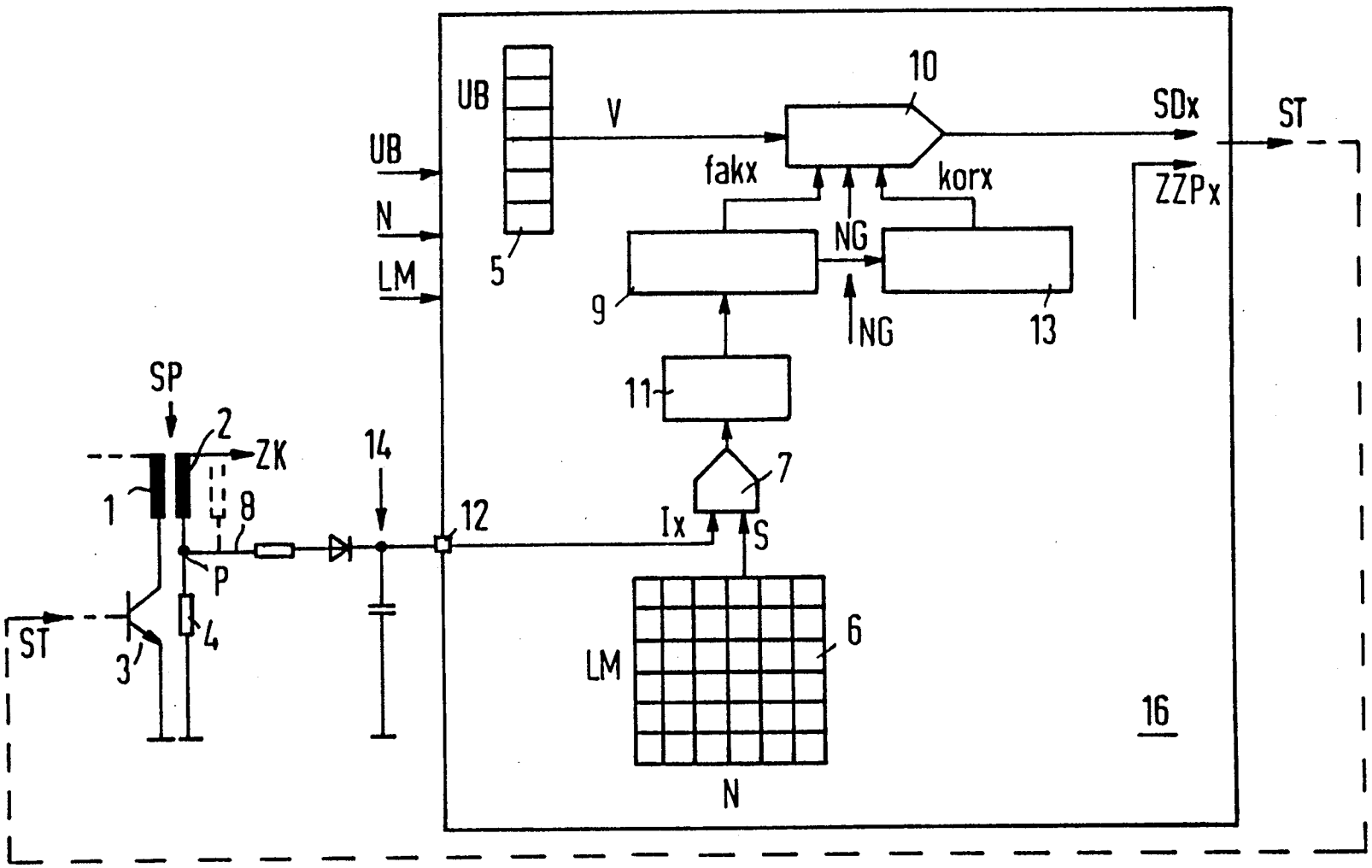
ST
SDx
ZZPx
16
13
korx
10
NG
NG
6
7
S
fakx
N
Ix
11
9
V
LM
UB
5
12
UB
N
LM
14
ZK
8
2
P
4
SP
1
3
ST

IGNITION DEVICE FOR INTERNAL COMBUSTION ENGINES

The invention relates to an ignition device for internal combustion engines, having at least one ignition coil with a secondary winding being separate from a primary winding, a first terminal of the secondary winding leading directly to a spark plug, or through a distributor to a plurality of spark plugs, a second terminal of the secondary winding of one ignition coil or of a plurality of ignition coils leading to a common point and from there through a sensor to a negative pole of a supply voltage source, and a measuring line leading from the common point, through a peak value rectifier, to an ignition control circuit contained in a microprocessor.

Such a device is disclosed in Published European Application No. 0 470 277 A1, corresponding to U.S. Pat. No. 5,143,042.

German Patent DE 27 59 154 C2, corresponding to British Patent No. 1 583 307, discloses an ignition device for internal combustion engines in which a spark discharge duration is regulated to a predetermined value, by comparing a period of time within which the spark discharge current has dropped to a predetermined discharge current level, with a predetermined command value, and readjusting the closing duration of the primary current circuit of the ignition coil as a function of the outcome of the comparison. That procedure is intended to preclude changes in the load of the spark plug, if soiling of the spark plug electrodes forms a shunt resistor or if the electrode spacing is increased by burnoff.

It is known from German Published, Non-Prosecuted Application DE-OS 21 45 285 that the initial current intensity in the ignition spark is important for igniting the fuel-air mixture in a cylinder.

However, that peak value and the slope of the dropping curve of the spark discharge current decrease with increasing soiling or with an increase in the electrode spacing, so that the available ignition energy can become less and less without bringing about readjustment of the closing duration in the subject of German Patent DE 27 59 154 C2, corresponding to British Patent No. 1 583 307.

In comparison, it is an object of the invention to provide an ignition device for internal combustion engines, which overcomes the disadvantages of the heretofore-known devices of this general type and which does so in such a way that spark plug loads and temperature effects of the ignition coil and manufacturer-specific differences among ignition coils and spark plugs, or in other words in the overall ignition circuit, can be recognized and compensated for.

With the foregoing and other objects in view there is provided, in accordance with the invention, an ignition device for internal combustion engines, comprising at least one ignition coil with separate primary and secondary windings, the primary winding having a primary current circuit, the secondary winding having a first terminal leading directly to a spark plug or through a distributor to a plurality of spark plugs, and the secondary winding having a second terminal; a common point connected to the second terminal of the secondary winding of one ignition coil or of a plurality of ignition coils; a sensor connected between the common point and a negative pole of a supply voltage source; a measuring line connected to the common point; a peak value rectifier connected in the measuring line; and a microprocessor having an ignition control circuit connected to the measuring line, the ignition control circuit including: a first memory region for storing pilot control values for a closing duration of the primary current circuit of the ignition coil, the pilot control values being associated with at least one operating parameter; a second memory region for storing command values for a peak value of an ignition current, the command values being dependent on at least one operating variable of an engine; a first computation circuit being connected to the measuring line for receiving an actual value of the peak ignition current value stored in the peak value rectifier and being connected to the second memory region for receiving the command value, and the first computation circuit calculating an adaptation value associated with a difference between the command value and the actual value; a third memory region connected to the first computation circuit for buffer-storing the adaptation value; and a second computation circuit connected to the third memory region and to the first memory region for varying the pilot control value as a function of the calculated adaptation value and for supplying a varied pilot control value being equal to the closing duration.

In accordance with another feature of the invention, there are provided means connected between the third memory region and the first computation circuit for specifying a upper limit value and a lower limit value for the adaptation value.

In accordance with a further feature of the invention, there are provided means for ascertaining the adaptation value (fakx) for each cylinder of the engine separately and cylinder-selectively below an engine rpm limit value; means for ascertaining the adaptation value (fakl) only for a predetermined first cylinder above the engine rpm limit value and for associating the adaptation value with all of the other cylinders; means for calculating and storing a correction value in memory for all of the other cylinders below the engine rpm limit value and associating the correction value with a ratio fakx/fakl; and means for linking the correction value above the engine rpm limit value with the adaptation value of the predetermined first cylinder additively or multiplicatively to form a new adaptation value.

In accordance with an added feature of the invention, there are provided means for beginning the computation of the correction values for the further cylinders after a predetermined number of engine revolutions subsequent to engine starting.

In accordance with an additional feature of the invention, there are provided means for selecting one operating parameter for the pilot control value as a supply voltage.

In accordance with yet another feature of the invention, there are provided means for selecting an upper limit value and a lower limit value for the value of the closing duration.

In accordance with a concomitant feature of the invention, there are provided means for setting at least one of the limit values in dependence on at least one operating parameter.

The peak value of the current flowing in the spark plug circuit or the secondary current circuit at the instant of ignition or shortly thereafter is compared with a command value, by means of an adjustment of the closing duration. If for any reason, such as the translation ratio or the quality of the ignition coil, the spark plug or cable spacing, soiling, contact burnoff, or so forth, the peak value is higher or lower than the specified command value, which in this exemplary embodiment is dependent on the engine rpm and the engine load, then the closing duration of the primary current circuit becomes shorter or longer in order to return the actual value to the command value in this way.

This assures an adequate initial or peak value of the ignition current, which is required for a safe mixture ignition, regardless of the further course of the ignition current.

Other features which are considered as characteristic for the invention are set forth in the appended claims.

Although the invention is illustrated and described herein as embodied in an ignition device for internal combustion engines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing.

BRIEF DESCRIPTION OF THE FIGURE

The drawing is a basic schematic and block circuit diagram of an exemplary embodiment of the ignition device according to the invention.

Referring now to the single FIGURE of the drawing in detail there is seen a primary winding 1 of an ignition coil SP which is triggered through a switching transistor 3. A secondary winding 2 has a first terminal connected to one or more spark plugs ZK and a second terminal connected through a sensor 4 to a negative pole of a non-illustrated supply voltage source. A further secondary winding of further ignition coils which may possibly be provided is suggested in dashed lines. The second terminals of these further coils lead to a common point P. From that point P, a measuring line 8 leads through a peak value rectifier 14 to a connection pin 12 of a microprocessor 16.

Up to this point, the circuit corresponds to the known ignition device that is the point of departure for the invention.

Through the use of software, the microprocessor 16 serves the function of an ignition control circuit. The most important variables in ignition control are the instant of ignition ZZP and the closing duration SD of the primary current. The onset of closure, as referred to the engine crank shaft position, can then be determined from these two variables.

The instant of ignition is ascertained in a manner which is known per se from various engine operating parameters and is of no further interest herein.

The onset of closure and the instant of ignition determine the beginning and end of a control pulse ST, which reaches the base of the switching transistor 3 and opens it, so that current can flow in the primary winding 1 of the ignition coil SP.

The peak value Ix of the secondary ignition current that occurs upon ignition of a certain cylinder x (Index x=1 . . . z, where z=the number of cylinders) is stored in memory in the peak value rectifier 14. The value of the closing duration includes a pilot control value V, which is weighted with an adaptation value fakx.

A plurality of pilot control values V are stored in a first memory region 5, in a table or performance graph, as a function of at least one operating parameter, such as the engine rpm N, the engine load LM, the engine temperature T or, as in the case of this exemplary embodiment, the supply voltage UB.

Command values S for the peak value of the ignition current are stored in a second memory region 6 in a performance graph, as a function of the engine rpm N and the engine load LM (measured through the air flow rate).

The actual value Ix and the command value S are transmitted at a suitable moment to a first computation circuit 7 (this and other computation circuits are included in software in the computing program of the microprocessor 16) that computes the adaptation value fakx associated with the difference between the two values, which is then stored in a buffer memory 9 providing a third memory region. The association may be performed additively, multiplicatively, or otherwise.

This buffer memory 9 has one memory place for each cylinder x of the engine, and the calculated adaptation value fakx is cylinder-selectively stored in this memory place until it is further processed for the next ignition process of that cylinder.

In a further program step, which is shown in the drawing as a further computation circuit 11, a check is also made prior to the buffer storage as to whether the computed value fakx is larger than a predetermined upper limit value (fakmax) or less than a predetermined lower limit value (fakmin). If so, then the value fakx is set to this limit value before the further processing and is then buffer stored. In order to determine the next closing duration SDx of this cylinder x, the instantaneously valid pilot control value V and the adaptation value fakx are transferred from their memories 5 and 9 to a second computation circuit 10, where they are linked together, additively or multiplicatively, for instance, to form the closing duration SDx of the cylinder x.

In order not to run up to the limit of the computation capacity of the microprocessor 16 and high engine rpm N, since this microprocessor has many calculations to perform, provision is made in this exemplary embodiment for the cylinder-selective computation of the adaptation value fakx to be performed only below a predetermined engine rpm limit value NG, and to calculate only the adaptation value fakl of a predetermined first cylinder (x=1) upon attainment or exceeding of this limit value and to use it for all of the other cylinders as well during one complete ignition cycle (two crank shaft revolutions in the case of a four-stroke engine).

To that end, in the rpm range below the engine rpm limit value NG for each further cylinder (x=2 . . . z), a correction value korx is calculated, which is associated with a ratio fakx/fakl, and is stored in a further memory region 13. These values remain in memory even after the engine has been shut off.

Above the engine rpm limit value ng, these correction values remain unchanged and are also used to form the closing duration values SDx. The calculation of new correction values is not begun until after a predetermined number of engine revolutions subsequent to engine starting.

The closing durations are thus computed as follows:

| | | | | | | | | | | |
|---|---|---|---|---|---|---|---|---|---|---|
| | | N | NG | | | | N | NG | | |
| SD1 | = | V | * | fak1 | SD1 | = | V | * | fak1 | |
| SD2 | = | V | * | fak2 | SD2 | = | V | * | fak1 | * kor2 |
| . | | . | | . | . | | . | | . | . |
| . | | . | | . | . | | . | | . | . |
| . | | . | | . | . | | . | | . | . |
| SDz | = | V | * | fakz | SDz | = | V | * | fak1 | * korz |

Before the closing duration values SDx ascertained in this way are output, a check is also performed in this exemplary embodiment as to whether they are greater than a predetermined upper limit value (SDmax) or less than a predetermined lower value (SDmin). These limit values may themselves preferably be stored in memory as a function of at least one operating parameter.

If the closing duration value is too low (SD<SDmin), reliable ignition is not assured, while if the closing duration value is too high (SD>SDmax), there is the danger that the ignition coil will heat up excessively.

We claim:

1. An ignition device for internal combustion engines, comprising:

at least one ignition coil with separate primary and secondary windings, said primary winding having a primary current circuit, said secondary winding having a first terminal leading to a spark plug, and said secondary winding having a second terminal;

a common point connected to said second terminal of said secondary winding;

a sensor connected between said common point and a negative pole of a supply voltage source;

a measuring line connected to said common point;

a peak value rectifier connected in said measuring line; and a microprocessor having an ignition control circuit connected to said measuring line, said ignition control circuit including:

a first memory region for storing pilot control values for a closing duration of said primary current circuit of said ignition coil, the pilot control values being associated with at least one operating parameter;

a second memory region for storing command values for a peak value of an ignition current, the command values being dependent on at least one operating variable of an engine;

a first computation circuit being connected to said measuring line for receiving an actual value of the peak ignition current value stored in said peak value rectifier and being connected to said second memory region for receiving the command value, and said first computation circuit calculating an adaptation value associated with a difference between the command value and the actual value a third memory region connected to said first computation circuit for buffer-storing the adaptation value; and a second computation circuit connected to said third memory region and to said first memory region for varying the pilot control value as a function of the calculated adaptation value and for supplying a varied pilot control value being equal to the closing duration.

2. The ignition circuit according to claim 1, wherein said first terminal of said secondary winding leads directly to the spark plug.

3. The ignition circuit according to claim 1, including a distributor through which said first terminal of said secondary winding leads to a plurality of spark plugs.

4. The ignition circuit according to claim 1, wherein said at least one ignition coil is a plurality of ignition coils having secondary windings with second terminals leading to said common point.

5. The ignition circuit according to claim 1, including means connected between said third memory region and said first computation circuit for specifying an upper limit value and a lower limit value for the adaptation value.

6. The ignition circuit according to claim 1, including means for ascertaining the adaptation value (fakx) for each cylinder of the engine separately and cylinder-selectively below an engine rpm limit value, means for ascertaining the adaptation value (fakl) only for a predetermined first cylinder above the engine rpm limit value and for associating the adaptation value with all of the other cylinders, means for calculating and storing a correction value in memory for all of the other cylinders below the engine rpm limit value and associating the correction value with a ratio fakx/fakl, and means for linking the correction value above the engine rpm limit value with the adaptation value of the predetermined first cylinder additively or multiplicatively to form a new adaptation value.

7. The ignition device according to claim 6, including means for beginning the computation of the correction values for the further cylinders after a predetermined number of engine revolutions subsequent to engine starting.

8. The ignition device according to claim 1, including means for selecting one operating parameter for the pilot control value as a supply voltage.

9. The ignition device according to claim 1, including means for selecting an upper limit value and a lower limit value for the value of the closing duration.

10. The ignition device according to claim 9, including means for setting at least one of the limit values in dependence on at least one operating parameter.

* * * * *